United States Patent [19]

Grosjean

[11] Patent Number: 4,958,334

[45] Date of Patent: Sep. 18, 1990

[54] BRACELET OF METALLIC CONSTRUCTION AND WATCH PROVIDED WITH SUCH A BRACELET

[75] Inventor: Laurent Grosjean, Neuchâtel, Switzerland

[73] Assignee: ETA SA Fabriques d'Ebauches, Grenchen, Switzerland

[21] Appl. No.: 397,733

[22] Filed: Aug. 23, 1989

[30] Foreign Application Priority Data

Aug. 24, 1988 [CH] Switzerland ..... 03143/88

[51] Int. Cl.[5] ..... G04B 37/00

[52] U.S. Cl. ..... 368/282

[58] Field of Search ..... 368/280–283; 224/169–180, 163, 164–168

[56] References Cited

U.S. PATENT DOCUMENTS

| | | | |
|---|---|---|---|
| 1,760,913 | 6/1930 | Otten . | |
| 2,652,612 | 9/1953 | Valcourt | 368/282 |
| 3,897,612 | 8/1975 | Bert | 224/177 |
| 4,561,077 | 12/1985 | Mock et al. | 368/282 |
| 4,653,933 | 3/1987 | Reichel | 368/282 |
| 4,690,567 | 9/1987 | Rebeaud | 368/282 |
| 4,821,532 | 4/1989 | Jaques et al. | 224/178 |
| 4,825,427 | 4/1989 | Wollman | 368/282 |
| 4,837,901 | 6/1989 | Bert | 224/164 |

FOREIGN PATENT DOCUMENTS 352965 4/1961 Switzerland .

*Primary Examiner*—Bernard Roskoski

*Attorney, Agent, or Firm*—Griffin, Branigan & Butler

[57] ABSTRACT

The bracelet of this invention, having metallic links (11, 12), includes hinge knuckles (17) of plastic material at its ends. Such hinge knuckles (17) permit, in particular, the avoidance of premature wear of the case (1) especially when the latter is of relatively soft material, for example plastic.

8 Claims, 2 Drawing Sheets

Fig. 1
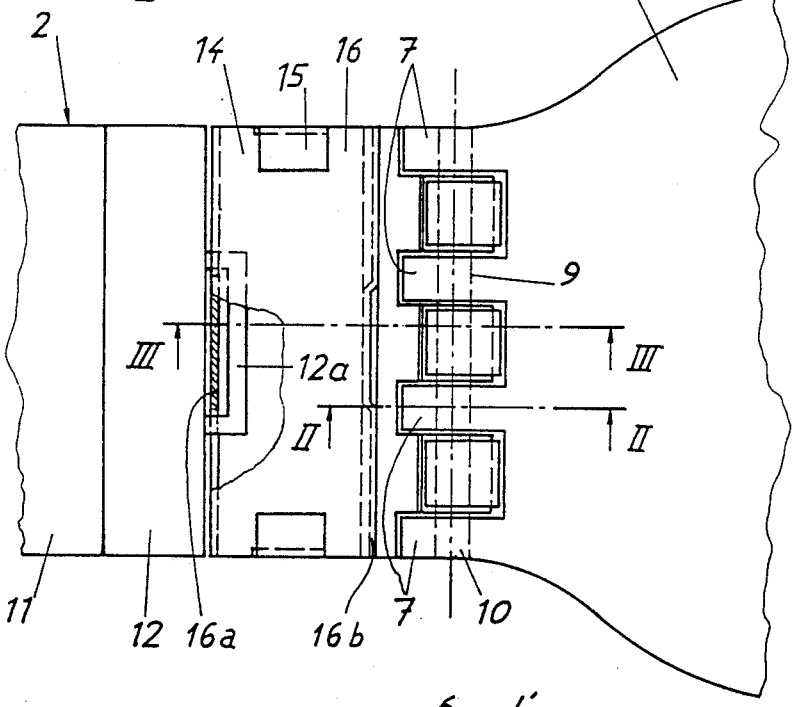
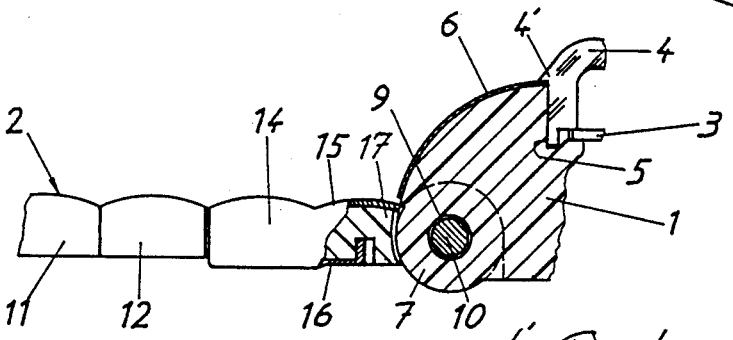
Fig. 2
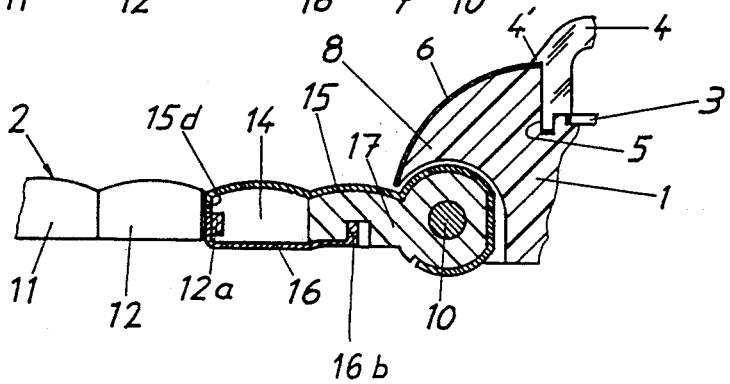
Fig. 3

BRACELET OF METALLIC CONSTRUCTION AND WATCH PROVIDED WITH SUCH A BRACELET

BACKGROUND OF THE INVENTION

This invention originates in the discovery of a problem which had not been noted up until the present and which relates to watches of the type which cannot be disassembled. It is known that for several years now watches of this type have met with growing success. The best known of such watches include a case body of plastic material which forms the periphery and bottom of the case and the inner surface of which is formed in a manner to support all the functional elements of the watch. This case body is capped by a dial through which pass the pipes of the indicator wheels and by a crystal which is permanently welded to the case body and retains the dial in place.

Up till the present time the bracelet of such watches was of flexible plastic material and the connection between the case body and the two strands of the bracelet was brought about by a hinge including a pin and two knuckles, each provided with at least three eyelets. In this arrangement the pin goes through the eyelets of the two knuckles and is force fitted into those of the knuckle attached to the bracelet. Patent document No. CH 647 917 describes this type of connection. In one example the case body is of the material known as ABS, while the bracelet is an elastomeric material or of PVC. For the case body materials known under the designations ASA or SAN may also be employed. These choices respond perfectly to the criteria which seek at the same time reliability and low production cost, such criteria being, as is well known, determinative in the construction of watches of the type not subject to being disassembled.

However, it has been noted that bracelets provided in accordance with these criteria have a life duration much shorter than that of the watch modules and the present invention aims to provide a solution to what appears at this point as a problem in conserving the advantages of watches of the type not subject to disassembly.

The research leading to this solution might suggest resort to metallic bracelets of a known type, but the latter necessitate the use of spring bars, the pivots of which are normally attached to lugs on the case body. However, case bodies provided with lugs are difficult to reconcile with manufacture in plastic material. Furthermore, such metallic bracelets may in rubbing against the lugs, wear them out rapidly, this going against the purpose which is here sought, which consists in increasing the normal duration of utilization of a watch made of plastic material.

SUMMARY OF THE INVENTION

The first objective of the invention is a bracelet of metallic construction including at least one end intended to be coupled in an articulated manner to a watch case, characterized in that said end includes a knuckle of plastic material exhibiting at least one eyelet intended to receive an articulation pin, said knuckle being confined in a hollow metallic link.

The second object of the invention is a watch including a case body of plastic material and a bracelet including two strands, each bracelet strand being coupled to the case body by a hinge characterized in that the hinge includes a first knuckle which is integral with the case body and of the same material and a second knuckle of plastic material, and in that the bracelet is formed of metal, the second knuckle of the hinge being rigidly fastened to a metallic end piece of the bracelet, said second knuckle being confined in a hollow metallic link.

Hereinafter there will be described by way of example an embodiment of the object of the invention which is illustrated by means of the attached drawings.

BRIEF DESCRIPTION OF THE DRAWINGS

FIG. 1 is a partial plan view from below of a watch and of one end of its bracelet;

FIG. 2 is a schematic cross-section along line II—II of FIG. 1;

FIG. 3 is schematic cross-section along line III—III of FIG. 1;

DESCRIPTION OF THE PREFERRED EMBODIMENT

Figure 4:
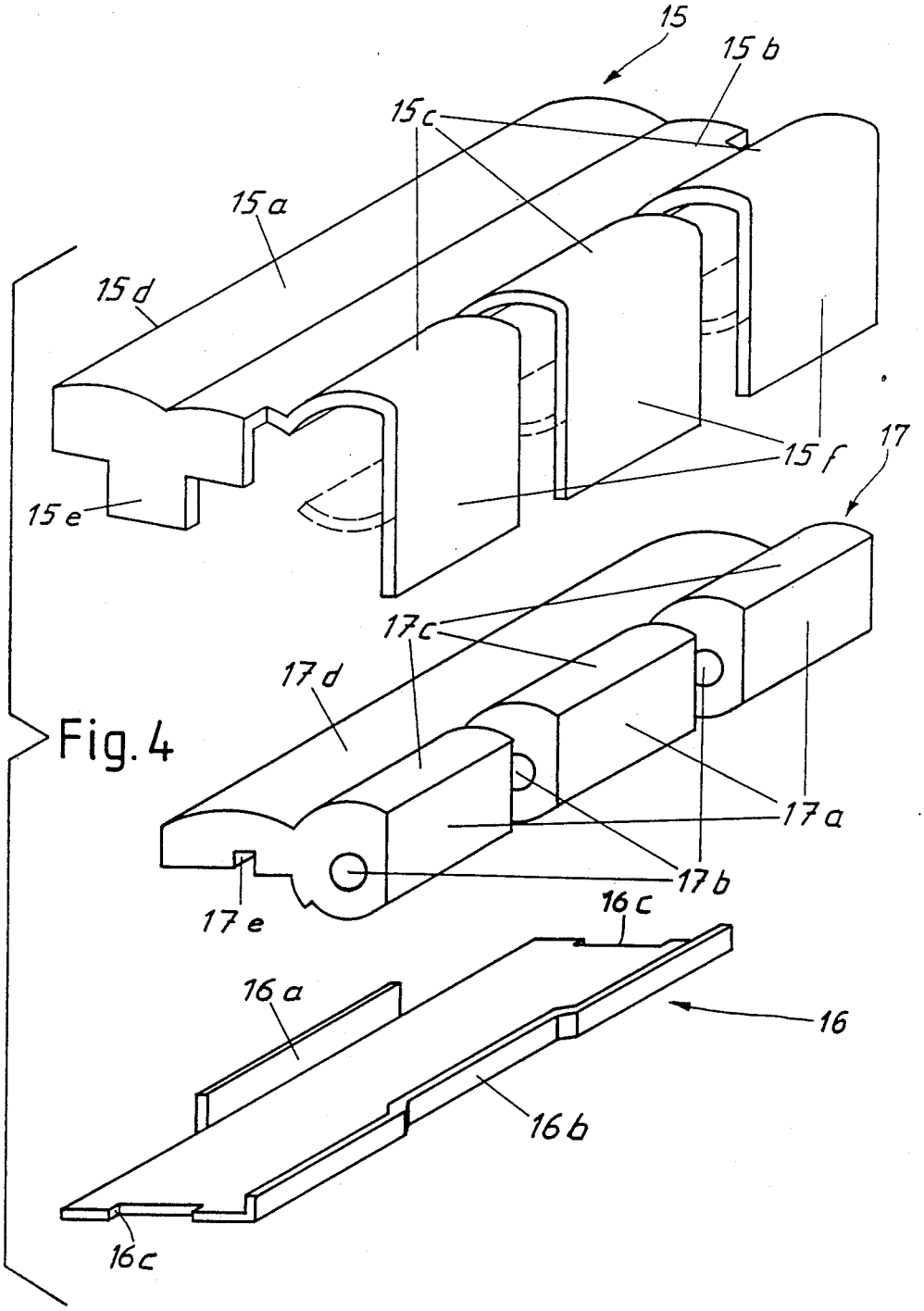
FIG. 4 is an exploded perspective view showing the end of the bracelet visible on FIG. 1.

The watch shown on the drawings includes a case body 1 in one piece formed from plastic material such as one of the materials designated as ABS, ASA or SAN for instance. It includes furthermore a bracelet 2 of which one strand is visible on the drawings. The case body 1 provides the back cover and the caseband in one piece and its inner surface is formed in a manner such as to constitute the cage of the watch, i.e. to support directly all the functional components: oscillator, motor, wheel works, integrated circuit, etc. A dial 3 covers the components. It is held in place by a crystal 4 of plastic material, for instance Plexiglass (registered trademark), which is permanently fastened in a watertight manner, for instance by welding, in an annular hollow 5. The upper surface of the case body is covered by metal cap 6. Such cap is rigidly held in place by crystal 4 by means of a heel 4' extending radially towards the periphery.

At 12 o'clock and at 6 o'clock, the case body 1 exhibits a knuckle formation, i.e. it is provided with four ribs 7 projecting from its lower side and having a connecting cover 8. The ribs 7 form the eyelets. They are pierced with coaxial circular holes 9 intended to accommodate a hinge pin 10.

As described hereinabove, a watch of this type may have a life duration of several years, for instance five years or even more. The back of the case is generally provided with an opening with a removable cover thus permitting periodic battery changes.

The bracelet 2 coupled to the watch as described is of the metallic type. Included among known metallic bracelets are those having articulated links, extensible bracelets formed of rigid elements coupled by springs, bracelets of metallic tissues, etc. In principle the bracelet for the watch as described may be of any of the known types, that which is shown on the drawing being preferably a bracelet of rigid links coupled by elastic elements. Such links are themselves formed from two segments of thin sheet metal blanked and formed or drawn in a manner to provide cages in which the elastic blades which couple the links to one another are engaged. Thus, on FIGS. 2 and 3, links 11 and 12 of bracelet 2 comprise rigid elements coupled in an extensible manner, but it seems unnecessary to provide here further details thereof. It is necessary nevertheless to mention that link 12 includes a lug **12*a* on its side adjacent link 14**. The function of such lug will be set out in detail hereinafter.

There remains to be described the last link 14 of each of the strands of bracelet 2. This link includes two sheet metal elements 15 and 16 and a knuckle 17. These elements 15 and 16 and knuckle 17 are shown on FIG. 4 before they have been assembled. The two elements 15 and 16 are initially blanked and partially formed and drawn in a manner to be adapted for assembly to one another by a bending operation.

More precisely, the upper element 15 exhibits three humped portions 15*a*, 15*b* and 15*c* on its upper face, a flap 15*d* on the edge intended to be adjacent link 12, two lateral tongues 15*e*, one only of which is visible on the drawing and three knuckle tabs 15*f*.

The two lateral edges of element 16 each comprise a cut out 16*c* into which tongues 15*e* are engaged.

The lower element 16 exhibits a plane surface of generally rectangular form. The longitudinal sides include on the one hand a tongue 16*a*, on the other a struck up flange 16*b*, both of which extend perpendicular to the planar surface. Tongue 16*a* is intended to be adjacent a link 12.

Knuckle 17 is of plastic material, advantageously of an elastic material chosen from among those generally employed for the manufacture of plastic bracelets. It includes three coaxial eyelets 17*a* of width greater than that of the tabs 15*f*. Each of these eyelets is pierced with a hole 17*b*, holes 17*b* being coaxial and of a diameter slightly less than that of the pin 10. The lower face of the knuckle 17 is provided with a rectilinear groove 17*e* perpendicular to the lateral edges of the bracelet. Finally, the upper face of the knuckle includes two humped portions 17*c* and 17*d* having substantially the same form as the humped portions 15*b* and 15*c* of element 15.

The assembly of link 14 and its attachment to the remainder of the bracelet is accomplished by means of a jig not shown on the drawing. Element 16 is initially set out flat in a manner such that tongue 16*a* and flange 16*b* are turned upwardly. The bracelet is next put into place with lug 12*a* hooking into tongue 16*a*. The knuckle 17 is placed over element 16 straddling flange 16*b*, this latter being engaged in groove 17*e*. Finally, element 15 covers the knuckle 17 and the element 16 in a manner such that the flap 15*d* is aligned with tongue 16*a* such that the two tongues 15*e* are engaged in the cut outs 16*c* and that the humped portions 15*c* and 15*b* are respectively aligned over the humped portions 17*c* and 17*d* of knuckle 17. The jig is then operated in order to fold the two tongues 15*e* and the three tabs 15*f*. More precisely, tongues 15*e* are folded under the lower face of element 16 while the tabs 15*f* are brought to match the form of eyelets 17*a*.

The assembly of the bracelet as thus realized with the case is brought about by meshing of eyelets 17*a* within the spaces comprised between the eyelets 7 of the case in a manner such that the holes 9 are coaxial with holes 17*b* and thereupon engaging pin 10 in holes 9 and 17*b*. Such pin 10 is retained by elastic clamping of the material of knuckle 17.

Should case 1 be provided with a cap 6, it will be noted that the watch is protected to a great extent by the metallic parts which improve the appearance on a long term basis. Furthermore, the connection of the metallic bracelet and the case remains simple, economic and without risking premature wear by the metallic bracelet of the lugs or the eyelets of the plastic case. Furthermore, in view of the tabs 15*f*, the portion of the bracelet of plastic material which is mechanically the weakest, is substantially reinforced.

In the watch as described, the hinge includes several eyelets, both on the bracelet and the case. Should the material of the case be sufficiently rigid, it is likewise possible to envisage the employment of a standard known structure with lugs and spring bars. Even here it is possible to employ a bracelet according to the invention. In such instance the essential function of the knuckle is that of avoiding wear of the case lugs by the bracelet when the material of such lugs is softer than that of the bracelet metal.

To obtain the ends of the bracelet, it would likewise be possible to manufacture the knuckles by direct moulding onto an assembled bracelet, the latter being introduced into a mould before the plastic material was injected therein.

In a simplified solution, it would likewise be possible to eliminate element 16 and to assure the fastening of element 15 by folding back the tongues and the tabs directly onto the knuckle 17. In this case the function of tongue 16*a* would be fulfilled by another tongue integral with element 15. Furthermore, the knuckle 17 could be elongated to the proximity of such tongue in order to assure blocking of lug 12*a*.

What I claim is:

1. A watch including a case body of plastic material and a bracelet including two strands each of which is coupled to the case body by a hinge, said hinge including a first hinge knuckle integral with the case body and formed of the same material and a second hinge knuckle of plastic material, said bracelet being of metal, said second hinge knuckle being rigidly fixed to and confined within a hollow metallic link forming a metallic end part of the bracelet.

2. A bracelet as set forth in claim 1 wherein the hollow metallic link is made up of two metallic plate segments bent or swaged onto one another, such link being hinged and/or coupled in an extensible manner to the rest of the bracelet.

3. A bracelet as set forth in claim 2 wherein the hinge knuckle of the bracelet exhibits a transversal groove in which is retained a folded flange of one of said plate segments.

4. A bracelet as set forth in claim 2 formed of a set of links of similar appearance to one another, hinged to one another or coupled in an extensible manner to one another, said hollow metallic link being of appearance similar to the other links.

5. A bracelet as set forth in claim 2 wherein one of the segments making up the hollow metallic link includes at least one tab, each eyelet being at least partially covered by a tab.

6. A bracelet as set forth in claim 1 wherein the hinge knuckle is provided with at least two coaxial eyelets.

7. A watch as set forth in claim 1 wherein the second hinge knuckle is of elastic plastic material and wherein a hinge pin is rigidly fixed by clamping to said second hinge knuckle.

8. A watch as set forth in claim 1 wherein the case body is overlaid with a metallic cap.

* * * * *